US011517811B1

(12) United States Patent
Tardiff, Sr.

(10) Patent No.: US 11,517,811 B1
(45) Date of Patent: Dec. 6, 2022

(54) DICE GAME AND ASSOCIATED DICE GAME ASSEMBLY FOR PLAYING THE SAME

(71) Applicant: Cal L. Tardiff, Sr., Fennville, MI (US)

(72) Inventor: Cal L. Tardiff, Sr., Fennville, MI (US)

( * ) Notice: Subject to any disclaimer, the term of this patent is extended or adjusted under 35 U.S.C. 154(b) by 0 days.

(21) Appl. No.: 17/943,271

(22) Filed: Sep. 13, 2022

(51) Int. Cl.
*A63F 9/04* (2006.01)

(52) U.S. Cl.
CPC ..... *A63F 9/04* (2013.01)

(58) Field of Classification Search
CPC ..... A63F 9/04; A63F 9/0402; A63F 9/20
See application file for complete search history.

(56) References Cited

U.S. PATENT DOCUMENTS 3,747,934 A * 7/1973 Barrett ..... A63F 9/0402 273/281
4,410,182 A * 10/1983 Francis ..... A63F 3/0415 273/DIG. 26
4,421,315 A * 12/1983 Cutler ..... A63F 9/0402 273/272
D323,859 S * 2/1992 Russell ..... D21/372
D393,883 S * 4/1998 Haygood ..... D21/372
6,942,218 B2 * 9/2005 Davis ..... A63F 9/0402 273/287
7,758,050 B2 * 7/2010 Denoual ..... A63F 3/00 273/393
2002/0145252 A1 * 10/2002 Michalek ..... A63F 9/04 273/146
2003/0111794 A1 * 6/2003 DiGirolamo ..... A63F 9/18 273/146

* cited by examiner

*Primary Examiner* — Michael D Dennis
(74) *Attorney, Agent, or Firm* — King & Partners, PLC

(57) ABSTRACT

A dice game assembly that is easy to assemble, disassemble, store and transport in a low-profile configuration, including: a left sidewall; a right sidewall; a backwall; wherein the left sidewall, the right sidewall, and the backwall form a dice collection region for collecting thrown dice proximate thereto; and twelve numerical gaming pieces, wherein the twelve numerical gaming pieces are independently rotatably displaceable between a first, unplayed position and a second, played position.

1 Claim, 9 Drawing Sheets

DICE GAME AND ASSOCIATED DICE GAME ASSEMBLY FOR PLAYING THE SAME

CROSS-REFERENCE TO RELATED APPLICATIONS

Not applicable.

STATEMENT REGARDING FEDERALLY SPONSORED RESEARCH OR DEVELOPMENT

Not applicable.

REFERENCE TO A SEQUENCE LISTING

Not applicable.

BACKGROUND OF THE INVENTION

1. Field of the Invention

The present invention relates in general to games, and, more particularly, to a dice game and associated assembly for playing the same that is easy to assemble and disassemble, as well as store and/or transport in a low-profile configuration. The dice game of the present invention is educational, fun, and cooperatively involves excitement, competition, strategy, skill, luck, and chance. The dice game of the present invention also provides hours of enjoyment for one or more players.

2. Background Art

Dice games and associated assemblies have been known in the art for years and are the subject of a plurality of patents and publications, including: U.S. Pat. No. 7,080,838 entitled "Method and Apparatus for a Dice Game," U.S. Pat. No. 6,942,218 entitled "Domino and Dice Game," U.S. Pat. No. 5,700,010 entitled "Method of Playing a Dice Wagering Game," U.S. Pat. No. 4,930,780 entitled "Dice Game," U.S. Pat. No. 4,648,602 entitled "Dice Game Apparatus," United States Patent Application Publication Number 2013/0026710 entitled "Dice Board Game Apparatus and Method of Play," United States Patent Application Publication Number 2004/0251626 entitled "Dice Game," U.S. Pat. No. RE39,770 entitled "Method of Playing a Dice Game," International Patent Number WO 2004/060507 entitled "Method and System for Playing Dice Game," and United Kingdom Patent Number GB 2,152,823 entitled "Dice Game Apparatus"—all of which are hereby incorporated herein by reference in their entirety including all references cited therein. U.S. Pat. No. 7,080,838 appears to disclose a unique entertaining board game where the total value of two dice of different colors or with a recognizable difference, one designating possible single value numerals, (1 through 6), and the other values of possible numerals, times ten, (10 through 60), are added together, creating a strictly unique sequence of thirty-six numerals. The object of the game is to have a fixed or moveable designated numeral to determine the beating of the ladder by the player rolling the dice with a score of the designated numeral or greater, while the other players bet that the score will be either higher or lower than the designated number. A bank pays the winnings and takes in the losses.

U.S. Pat. No. 6,942,218 appears to disclose a domino and dice game that includes a series of dominos having counts thereon which correspond to the possible counts generated by a pair of conventional cubical dice. The dominos are initially positioned face up, and the dice are tossed. Dominos having counts corresponding to the resulting count on the dice, are turned face down. Play continues by a single player until no more domino moves are possible, whereupon play transfers to the next player. Score is according to the number of dots displayed upon the remaining face up dominos after a turn is completed, with low score winning the round after all players have played. The present game also includes a playing box, with the box having at least one row of dominos pivotally secured thereacross and a dice tossing area. The playing box may include additional domino rows for doubles and blank dominos, if desired.

U.S. Pat. No. 5,700,010 appears to disclose a dice game employing a single die. The shooter rolls the die a number of times until either the same die face is rolled twice or until each of the die faces one through six have been rolled, in either case the shooter's turn ends. The primary bets which may be placed with the house are, that a particular number will be rolled before the shooters turn ends. Primary bets pay 2 for 1. If the shooter's turn ends after all six dice faces have been rolled, all primary bets winnings are doubled or tripled by the house. A second set of bets is based on at least three, four, five, or six dice being rolled before the end of the shooters turn and in addition having a particular pattern such as the dice rolls all being sequentially higher or lower than the previous roll. These bets have odds ranging from 5 for 1 to 25,000 for 1. The primary and secondary type of bets are placed before a turn is begun. During the play of a particular turn bets may be placed on the outcome of the next roll of the die which results in a return of 5 for 1. Additional bets which may be placed are where the first two or more rolls are specified exactly. Lastly, bets may be placed on the number of successful rolls.

U.S. Pat. No. 4,930,780 appears to disclose a method of playing a dice game wherein a dice box having two play compartments in separated by a common wall, one compartment of which is used to catch the dice when thrown, the second compartment acting as a holding area in which dice are placed that have been counted in scoring, taking them temporarily out of action. The game is played with six dice. Ones, fives and certain multiple combinations are scored. Players may rethrow any dice which miss the play compartment, and any score changes being caused by one die hitting another in the play compartment are counted. A player must voluntarily surrender his turn while still accumulating score in order for that score to be counted; if he fails to score on any throw of the dice, any score accumulated during that turn is canceled.

U.S. Pat. No. 4,648,602 appears to disclose a dice box in the shape of a bowl with sloping side walls terminating in a planar bottom surface. The side walls and bottom surface are covered with mohair, felt or other similar covering. A horizontal planar rim of substantial width has discrete portions connected to each side wall of the box. The number of sidewalls and rim portions are selected in accordance with the maximum number of players which can use the apparatus to participate in a game and are formed from a material which can be written upon and erased, such as slate. Up to ten dies are provided along with writing instruments susceptible to being used with the particular writing surface rim portions and an eraser. Two or more dies are thrown into the dice box by the players and scores recorded on the rim portion of the dice box assigned to each player in accordance with their dice thrown until the game is completed in accordance with predetermined rules. As a score changes or after the game is completed, each writing surface is erased and thus made ready for the next score to be recorded or game use.

United States Patent Application Publication Number 2013/0026710 appears to disclose a board game for teaching basic arithmetic and mathematical operations (such as addition, subtraction and multiplication) along with the order of operations to children in need of such skills. The game board includes a continuous playing path having a series of playing positions there along, with each of the positions requiring a player to roll combinations of polyhedral dice and using mathematical operations to achieve a score for each turn along the playing path. Play proceeds as described above until a predetermined total amount of points is achieved.

United States Patent Application Publication Number 2004/0251626 appears to disclose a dice game that includes provision for a series of wagers on virtually any possible outcome of the toss of a pair of conventional cubical dice. The present game allows players to place wagers on the possibility of (a) a specific single number coming up on either of the dice, (b) any doubles number in general, (c) a specific additive total counting both dice, (d) an odd or even number additive total, and/or (e) a high or low additive total, i.e. above or below a median number. Odds are provided in accordance with the probability of each of the above noted possibilities occurring. The present game is well suited for casino play, and a gaming table layout is provided with a series of player stations each having a series of positions for placing wagers in accordance with the above possibilities.

U.S. Pat. No. RE39,770 appears to disclose a novel game and board or surface that is played in combination with two sets of playing pieces consisting of three dice each, one set being visibly distinguishable from the second set and wherein in one embodiment all bets are placed on the board or surface before the first set of dice is throw to speed up the method of play and payoffs for each bet are set by the house. Optionally, the house may set and take additional bets between a throw of the first set of dice and a throw of the second set of dice. In another embodiment of the invention, players use the two sets of dice in sequence wherein winning bets are related to poker hands such as open numbers from 3-35; 3 of a kind; 4 of a kind; 5 of a kind, straight; any 3 pair; 6 of a kind, and six sixes (but specifically excluding two of a kind to provide decisive winning odds for the house) and where the payoffs for each bet are 2 for 1, 3 for 1, 4 for 1, 5 for 1, 8 for 1, 8 for 1, 12 for 1, and 20 for 1, respectively, for example. In yet another embodiment of the invention, odds for all bets are again set by the house and a defined whole or percentage of the remaining losing bets form a progressive pot for 6 of a kind and/or six sixes comprises part of the betting.

International Patent Number WO 2004/060507 appears to disclose a method of playing a dice game with a plurality of players that comprises selecting a first shooter, and designating players into first and second groups. Players in the first group then bet money, in sequence, in favor of the first shooter winning, based on the dice throw, and players in the second group then bet, in sequence, against the first shooter winning. The first shooter rolls the dice, and the first shooter wins or loses based on a designated set of winning and a designated set of losing numbers. If the first shooter wins, the losing second group players' money is dispersed to the first player group in the sequence and based on the amount bet by each of the players in the first player group. If the first shooter loses, the losing first group players' money is dispersed to the second player group in a similar sequence.

United Kingdom Patent Number GB 2,152,823 appears to disclose a flat carrier member that has seatings each shaped so as to trap a respective dice, but to allow it to turn freely, this being facilitated by slight rounding of the edges and corners of the dice, each seating being formed with circular openings in opposite faces of the carrier member through which portions of the dice project and are visible. When rubbed between the hands of a player, the dice can thus roll over quite freely. The thickness of the carrier member is slightly less than that of the individual dice so that when placed on a flat surface, the dice are turned so that one face lies flat on the surface and the opposite face is clearly visible.

While the above-identified patents and publications do appear to disclose various dice games and associated assemblies, their configurations remain non-desirous and/or problematic inasmuch as, among other things, none of the above-identified games and puzzles appear to provide, a three-dimensional dice game assembly and rules for playing the same as disclosed herein that are educational, fun, cooperatively involve excitement, competition, strategy, skill, luck, and chance.

These and other objects of the present invention will become apparent in light of the present specification, claims, and drawings.

SUMMARY OF THE INVENTION

The following presents a simplified summary in order to provide a basic understanding of some aspects of the claimed subject matter. This summary is not an extensive overview, and is not intended to identify key/critical elements or to delineate the scope of the claimed subject matter. Its purpose is to present some concepts in a simplified form as a prelude to the more detailed description that is presented later.

The present invention is directed to a dice game assembly that is easy to assemble, disassemble, store and transport in a low-profile configuration, comprising, consisting essentially of and/or consisting of: (a) a left sidewall; (b) a right sidewall; (c) a backwall; (d) wherein the left sidewall, the right sidewall, and the backwall form a dice collection region for collecting thrown dice proximate thereto; and (e) twelve numerical gaming pieces, wherein the twelve numerical gaming pieces are independently rotatably displaceable between a first, unplayed position and a second, played position.

In a preferred embodiment of the present invention, the left and right sidewalls each include two slots.

In another preferred embodiment of the present invention, the left sidewall and the right sidewall each include an inner surface, an outer surface, a front surface, a front canted surface, a top surface, a rear canted surface, a rear surface, and a bottom surface.

In yet another preferred embodiment of the present invention, the left sidewall and the right sidewall each include an upper aperture adapted for receiving a rod therethrough.

In one preferred embodiment of the present invention, the backwall includes two left tabs adapted for releasable securement to the left sidewall, and two right tabs adapted for releasable securement to the right sidewall.

In a preferred implementation of the present invention, the backwall includes a front surface, a back surface, a left side surface, a top surface, a right side surface, and a bottom surface.

In another preferred implementation of the present invention, a rod secures the twelve numerical gaming pieces above at least a portion of the backwall.

In yet another preferred implementation of the present invention, each one of the twelve numerical gaming pieces is secured to a rod via a fastener.

The present invention is also directed to a dice game assembly that is easy to assemble, disassemble, store and transport in a low-profile configuration, comprising, consisting essentially of and/or consisting of: (a) a left sidewall, wherein the left sidewall includes two slots, an inner surface, an outer surface, a front surface, a front canted surface, a top surface, a rear canted surface, a rear surface, and a bottom surface; (b) a right sidewall, wherein the right sidewall includes two slots, an inner surface, an outer surface, a front surface, a front canted surface, a top surface, a rear canted surface, a rear surface, and a bottom surface; (c) wherein the left sidewall and the right sidewall each include an upper aperture adapted for receiving a rod therethrough; (d) a rod, wherein the rod is secured to the left sidewall and the right sidewall; (e) a backwall, wherein the backwall includes two left tabs adapted for releasable securement to the left sidewall, two right tabs adapted for releasable securement to the right sidewall, a front surface, a back surface, a left side surface, a top surface, a right side surface, and a bottom surface; (f) wherein the left sidewall, the right sidewall, and the backwall form a dice collection region for collecting thrown dice proximate thereto; (g) twelve numerical gaming pieces, wherein the twelve numerical gaming pieces are independently rotatably displaceable between a first, unplayed position and a second, played position; (h) wherein the rod secures the twelve numerical gaming pieces above at least a portion of the back wall; and (i) wherein each one of the twelve numerical gaming pieces is secured to a rod via a fastener.

BRIEF DESCRIPTION OF THE DRAWINGS

Certain embodiments of the present invention are illustrated by the accompanying figures. It will be understood that the figures are not necessarily to scale and that details not necessary for an understanding of the invention or that render other details difficult to perceive may be omitted.

It will be further understood that the invention is not necessarily limited to the particular embodiments illustrated herein.

Figure 1:
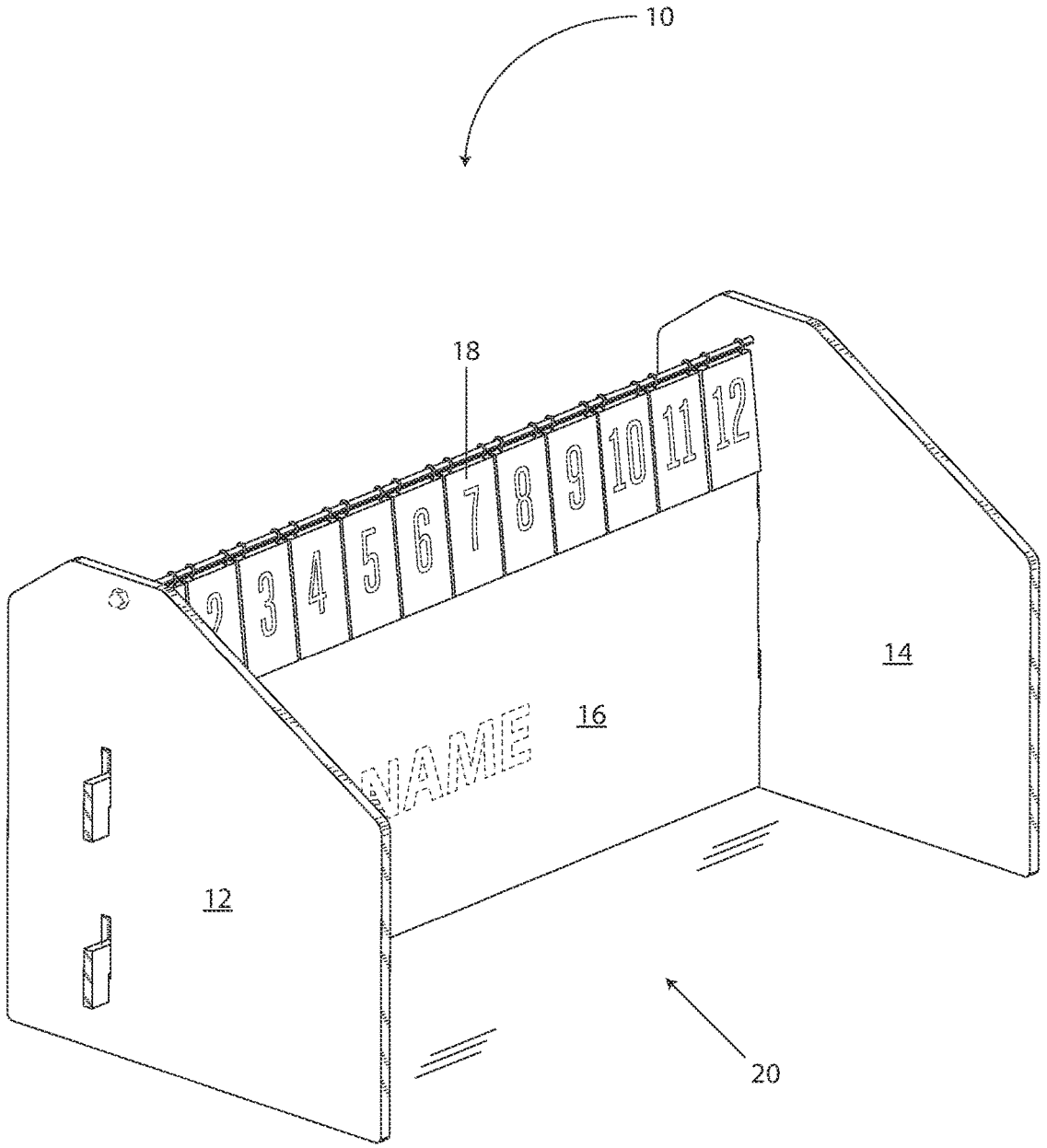
Figure 2:
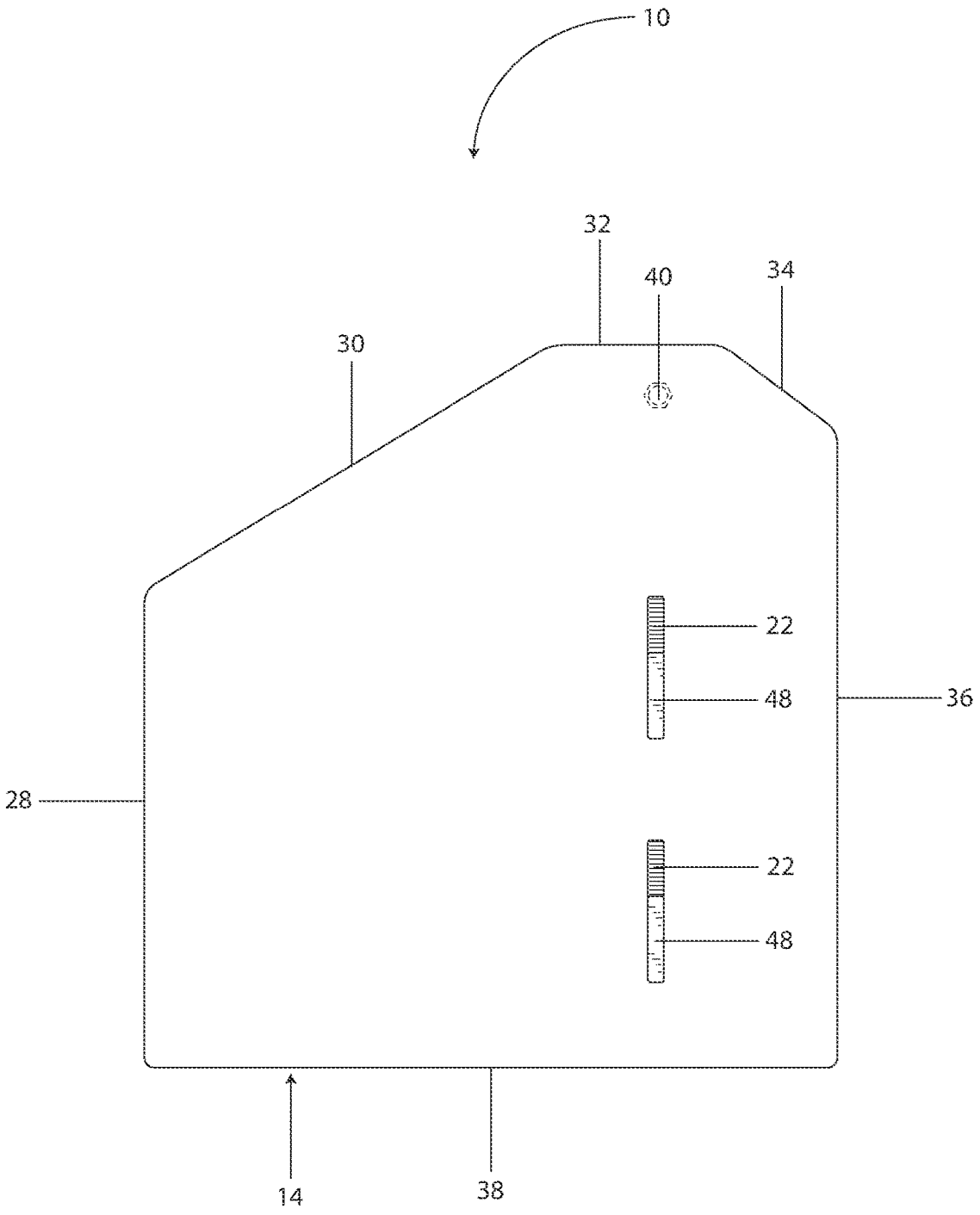
Figure 3:
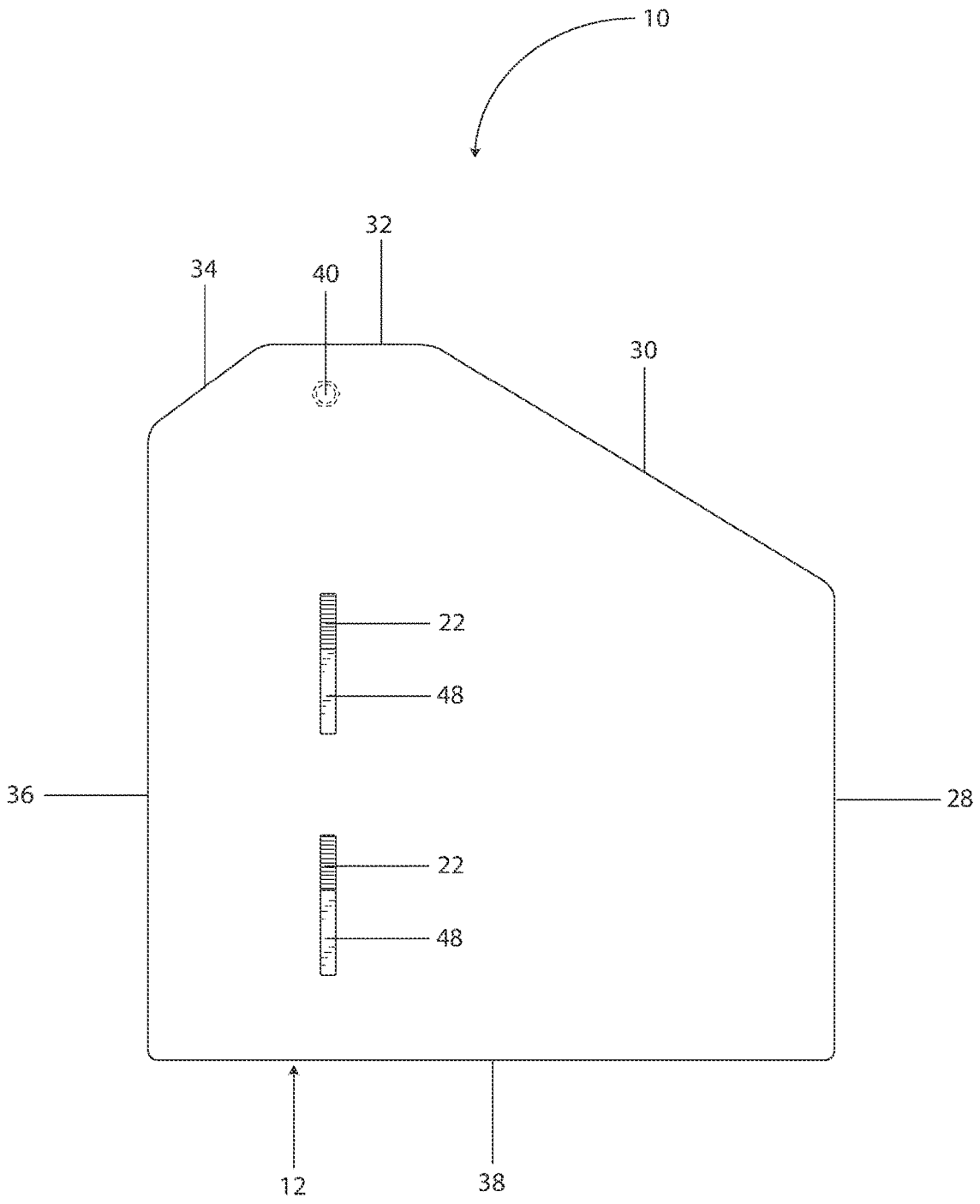
Figure 4:
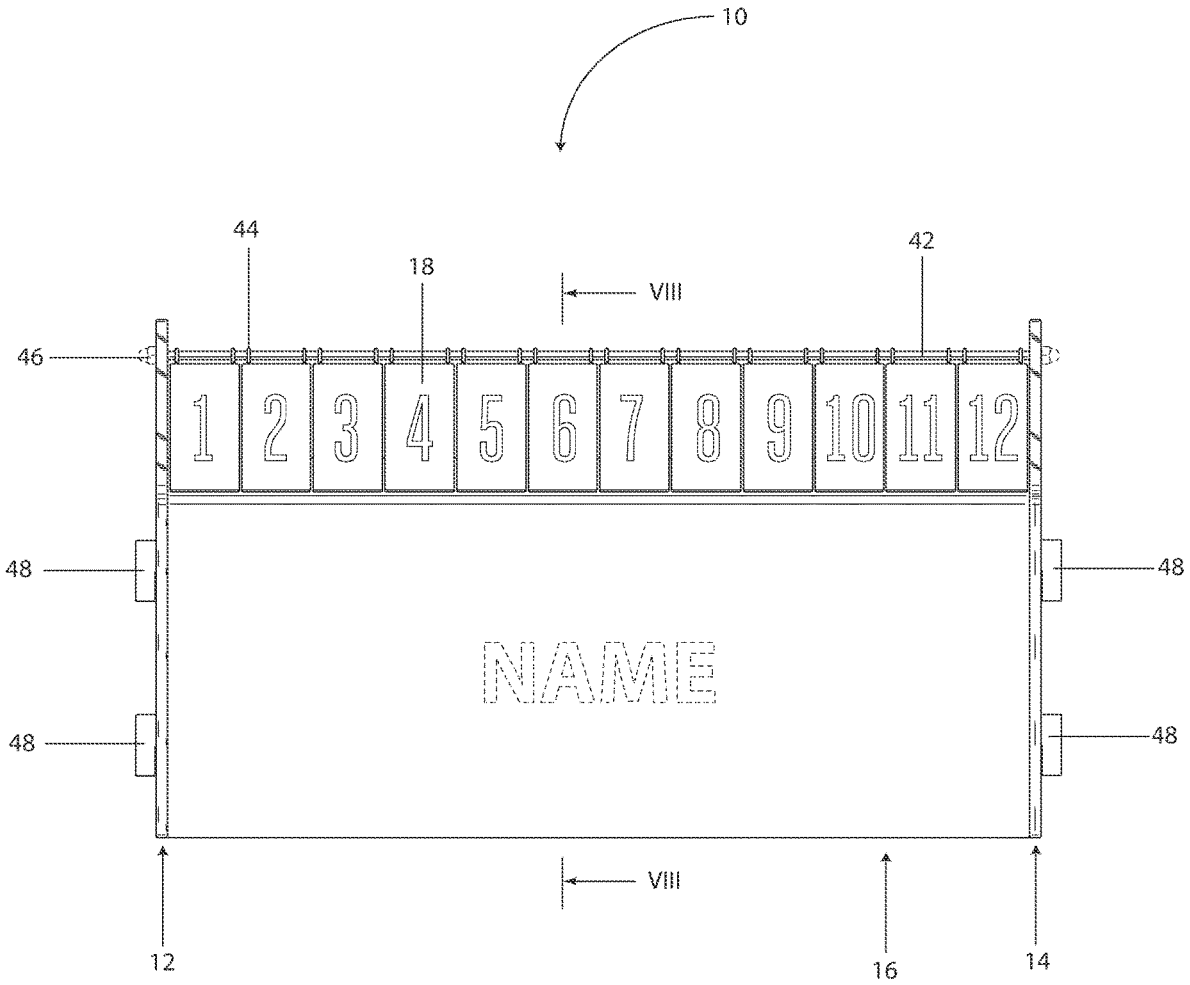
Figure 5:
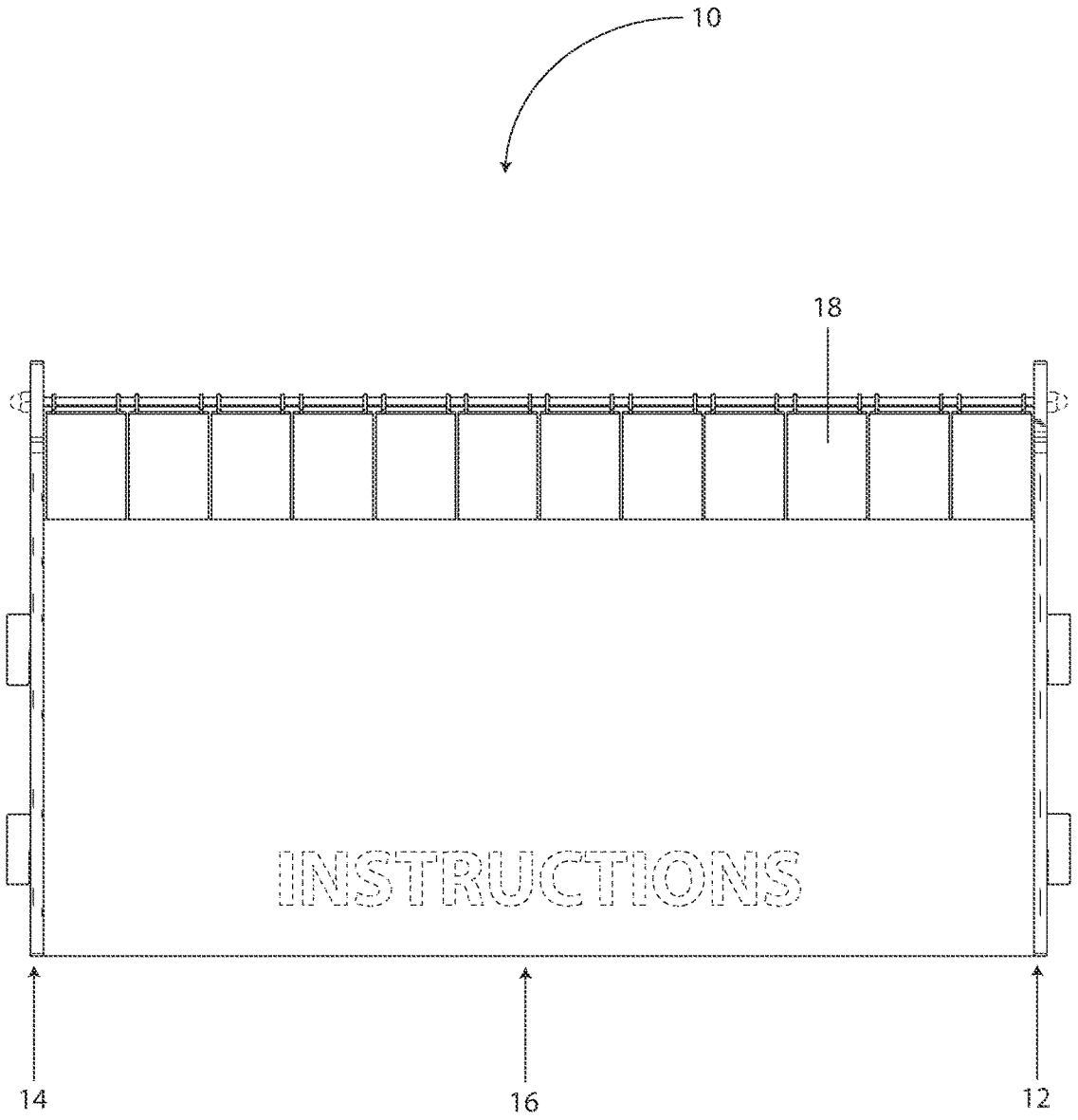
Figure 6:
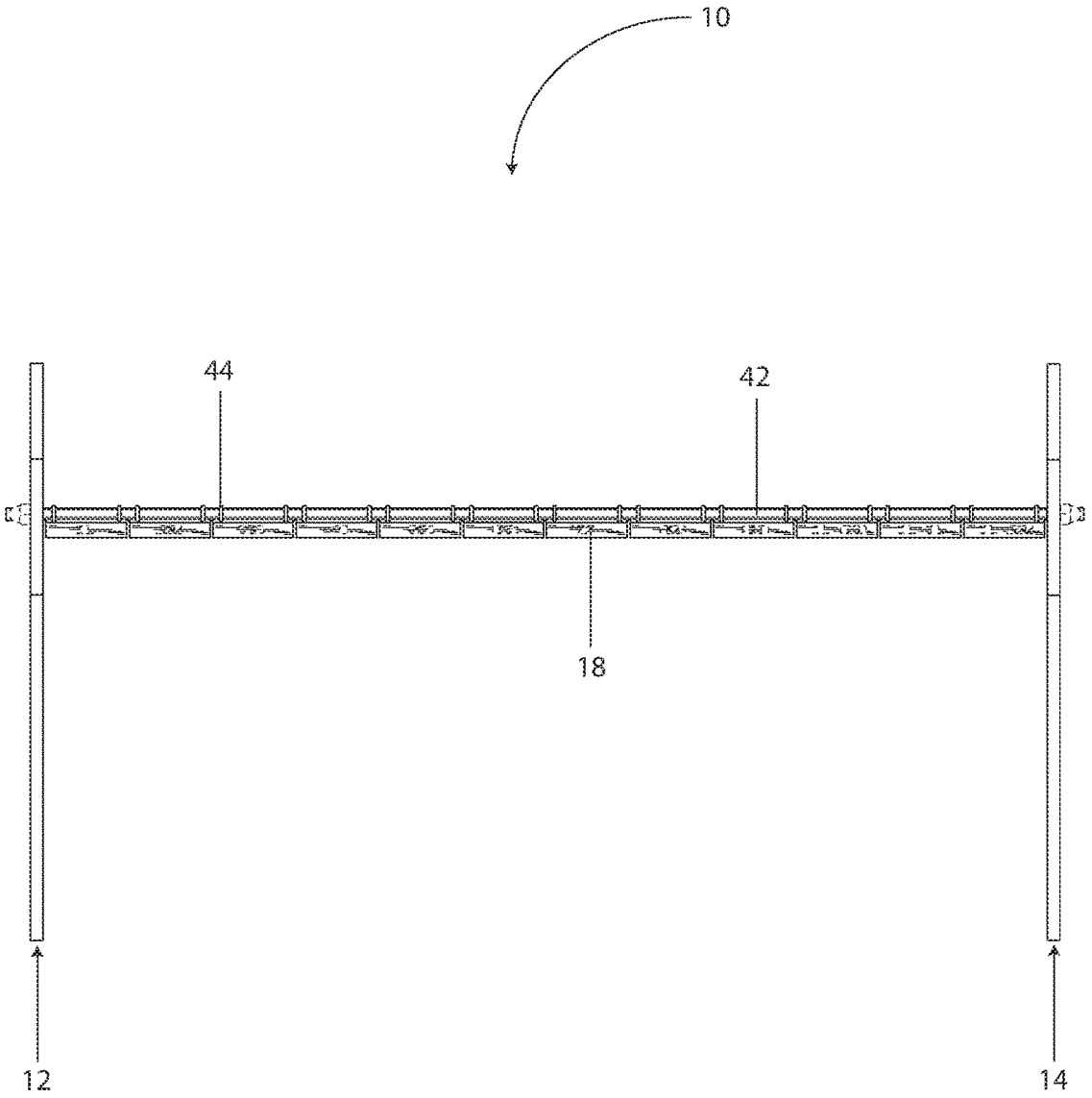
Figure 7:
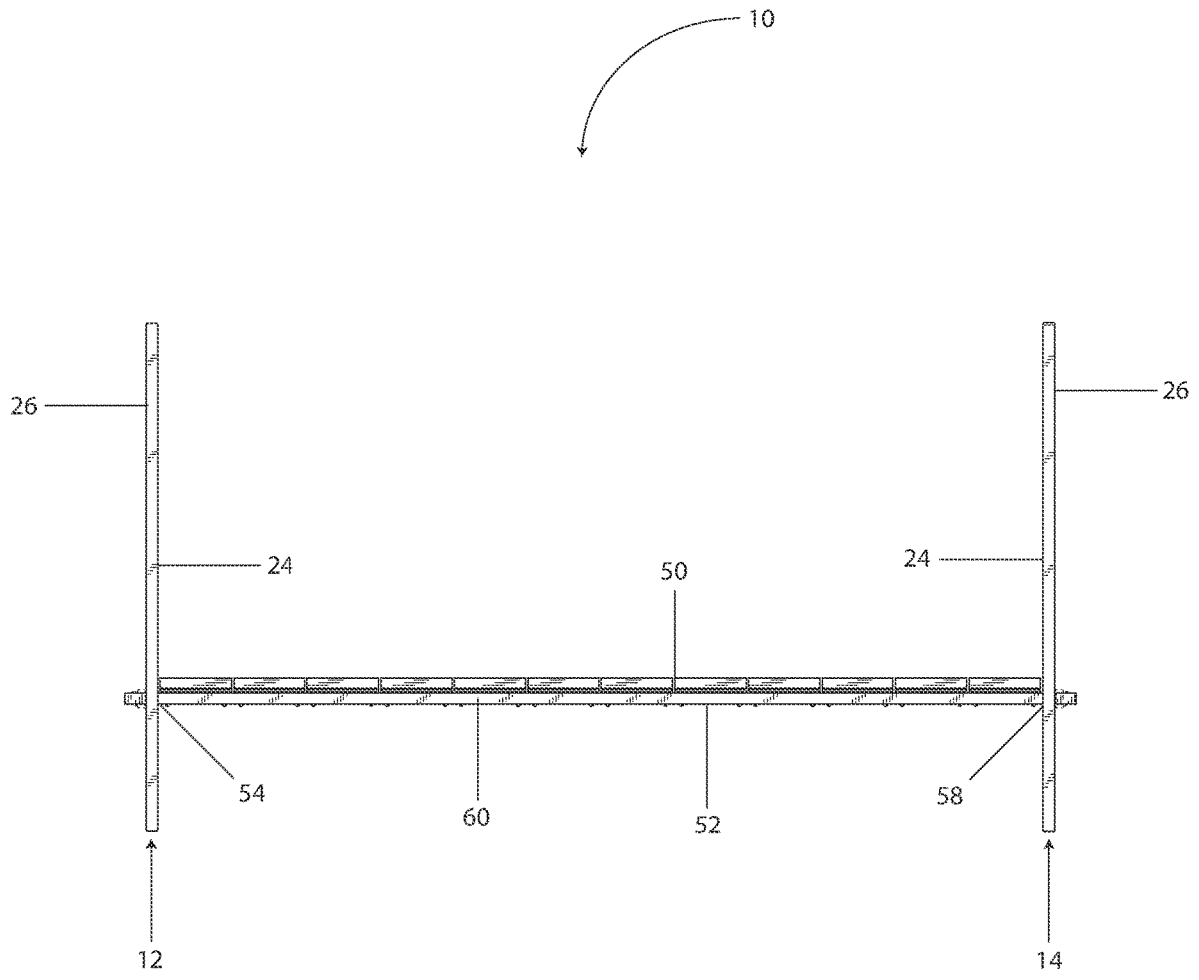
Figure 8:
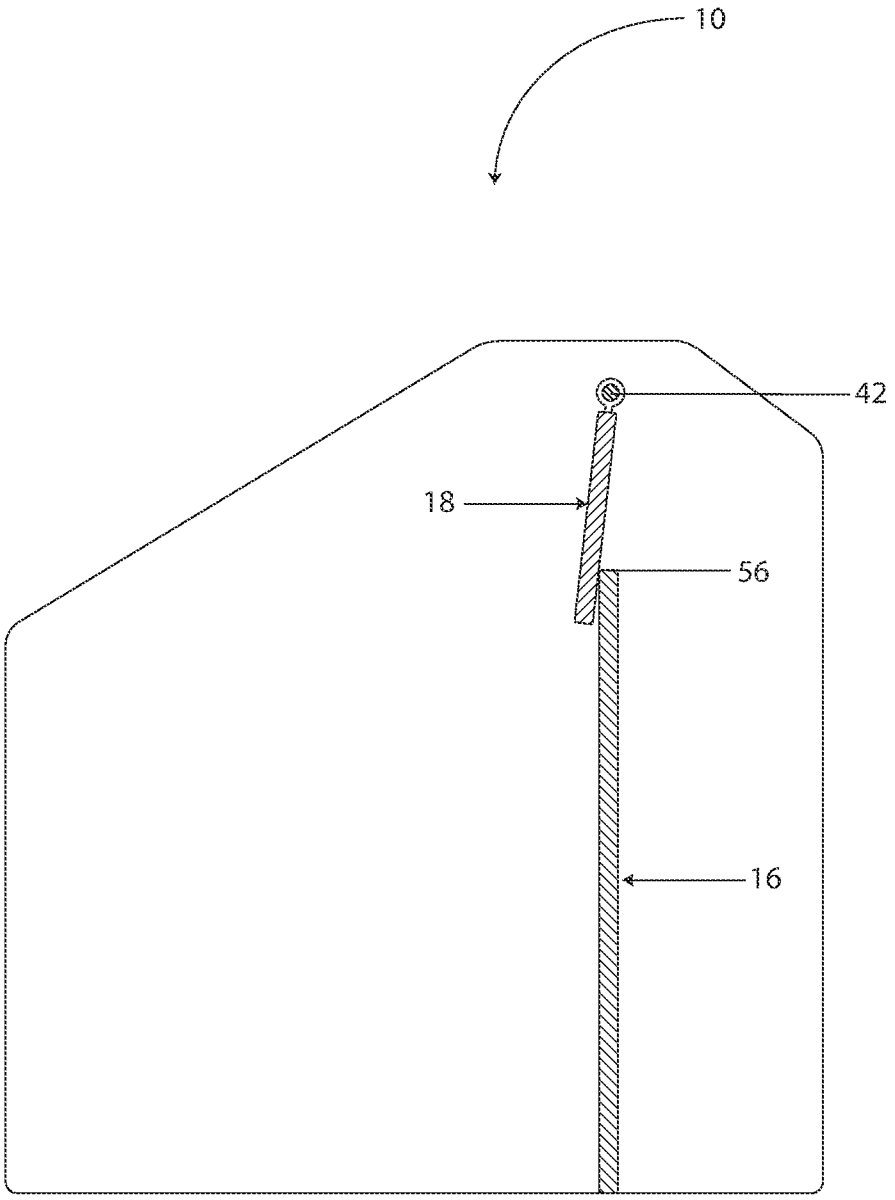
Figure 9:
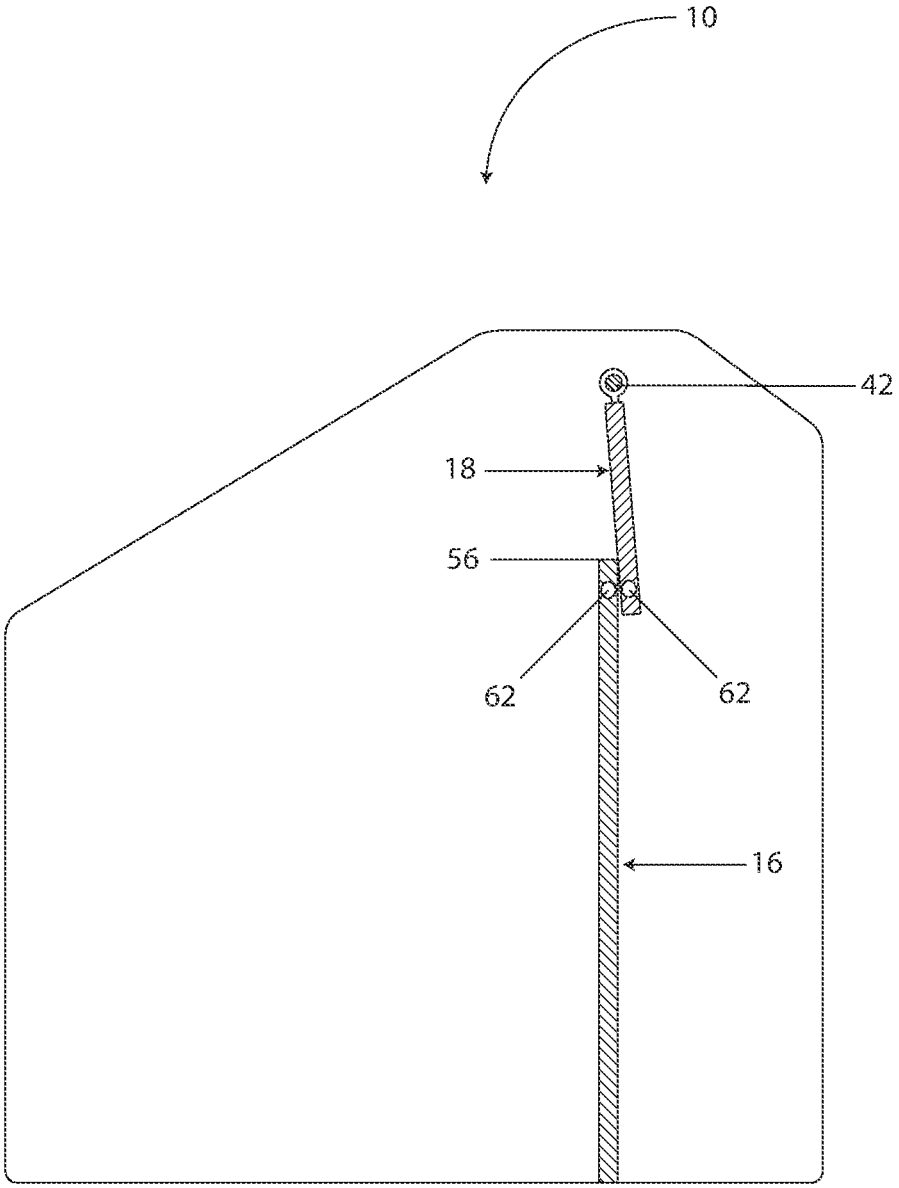

The invention will now be described with reference to the drawings wherein:

FIG. 1 of the drawings is a perspective view of a dice game assembly of the present invention;

FIG. 2 of the drawings is a right side view of the dice game assembly of FIG. 1;

FIG. 3 of the drawings is a left side view of the dice game assembly of FIG. 1;

FIG. 4 of the drawings is a front view of the dice game assembly of FIG. 1;

FIG. 5 of the drawings is a rear view of the dice game assembly of FIG. 1;

FIG. 6 of the drawings is a top view of the dice game assembly of FIG. 1;

FIG. 7 of the drawings is a bottom view of the dice game assembly of FIG. 1;

FIG. 8 of the drawings is a cross-sectional view of the dice game taken along line VIII of FIG. 4 showing a numerical game piece in a first, unplayed position; and FIG. 9 of the drawings is a cross-sectional view of the dice game showing a numerical game piece in a second, played position.

DETAILED DESCRIPTION OF THE INVENTION

While this invention is susceptible of embodiment in many different forms, there is shown in the drawings and described herein in detail several specific embodiments with the understanding that the present disclosure is to be considered as an exemplification of the principles of the invention and is not intended to limit the invention to the embodiments illustrated.

It will be understood that like or analogous elements and/or components, referred to herein, may be identified throughout the drawings by like reference characters. In addition, it will be understood that the drawings are merely schematic representations of one or more embodiments of the invention, and some of the components may have been distorted from their actual scale for purposes of pictorial clarity.

Referring now to the drawings, and to FIGS. 1-9 in particular, dice game assembly 10, that is easy to assemble, disassemble, store and transport in a low-profile configuration, is disclosed as generally comprising left sidewall 12, right sidewall 14, backwall 16, and numerical gaming pieces or placards 18. These gaming pieces are independently rotatably displaceable between a first, unplayed position (See FIG. 8) and a second, played position (See FIG. 9). Left sidewall 12, right sidewall 14, and backwall 16 form dice collection region 20 for collecting thrown dice proximate thereto. Ideally, the collection region keeps the dice from falling off of the playing surface (e.g., table, desk, counter, etcetera). It also serves as a deflective surface for the pair of dice to be thrown against in addition to the sidewalls and backwall.

Preferably, left sidewall 12 and right sidewall 14 include slots or apertures 22 for releasably retaining tabs from the backwall. Furthermore, left sidewall 12 and right sidewall 14 preferably include inner surface 24, outer surface 26, front surface 28, front canted surface 30, top surface 32, rear canted surface 34, rear surface 36, and bottom surface 38. In addition, left sidewall 12 and right sidewall 14 each include upper aperture 40 which is adapted for receiving rod 42 therethrough. Rod 42 secures the twelve numerical gaming pieces above at least a portion of the backwall. Fasteners 44 secure the twelve numerical gaming pieces to the rod. Rod 42 is secured to the left and right sidewalls via nut 46.

In one implementation of the present invention, backwall 16 includes tabs 48 which are adapted for releasable securement to the sidewalls. Backwall 16 preferably includes front surface 50, back surface 52, left side surface 54, top surface 56, right side surface 58, and bottom surface 60.

In accordance with the present invention, the components of dice game assembly 10 are preferably fabricated from a material selected from the group consisting of a metal, a metal alloy, a natural resin, a synthetic resin, a plastic, a composite, and/or wood.

In one embodiment of the present invention (See FIG. 9), the backwall and the numerical gaming pieces include magnets 62 so the pieces have a snap fit or snap completion to any movement. Essentially, the user flips the particular gaming piece over and it snaps into a final, temporarily locked/played position.

GAME PLAY—The object of the game is to attain the lowest possible total score by rolling the two dice (each six sided). Each player rolls the dice until they run out of choices. You may use a single number or any combination of numbers to reduce the total score. The remaining numbers are then added up to give your final score. For example, if you roll a number 2 and 5 with the dice (by rolling the dice into the containment region (sidewalls, backwall, and/or playing surface of the table)), you may choose to eliminate (i.e., flip over) the numeric game piece(s) that correspond to the number 7 or the numbers 2 and 5. There is no limit to the number of players per game. The lowest possible score per game and/or round is 0 and the highest score is 75 based on a triple role of double ones. You may play one round or a plurality of rounds and total the score, either individually or as a team.

The foregoing description merely explains and illustrates the invention and the invention is not limited thereto except insofar as the appended claims are so limited, as those skilled in the art who have the disclosure before them will be able to make modifications without departing from the scope of the invention.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etcetera shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etcetera. As a non-limiting example, each range discussed herein can be readily broken down into a lower third, middle third and upper third, etcetera. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed and desired to be secured by Letters Patent of the United States is:

1. A dice game assembly that is easy to assemble, disassemble, store and transport in a low-profile configuration, consisting of:

a left sidewall, wherein the left sidewall includes two slots, an inner surface, an outer surface, a front surface, a front canted surface, a top surface, a rear canted surface, a rear surface, and a bottom surface;

a right sidewall, wherein the right sidewall includes two slots, an inner surface, an outer surface, a front surface, a front canted surface, a top surface, a rear canted surface, a rear surface, and a bottom surface;

wherein the left sidewall and the right sidewall each include an upper aperture adapted for receiving a rod therethrough;

a rod, wherein the rod is secured to the left sidewall and the right sidewall;

a backwall, wherein the backwall includes two left tabs adapted for releasable securement to the left sidewall, two right tabs adapted for releasable securement to the right sidewall, a front surface, a back surface, a left side surface, a top surface, a right side surface, and a bottom surface;

wherein the left sidewall, the right sidewall, and the backwall form a dice collection region for collecting thrown dice proximate thereto;

twelve numerical gaming pieces, wherein the twelve numerical gaming pieces are independently rotatably displaceable between a first, unplayed position and a second, played position;

wherein the rod secures the twelve numerical gaming pieces above at least a portion of the back wall; and wherein each one of the twelve numerical gaming pieces is secured to a rod via a fastener.

* * * * *